US011365094B2

(12) United States Patent
Rocher et al.

(10) Patent No.: US 11,365,094 B2
(45) Date of Patent: Jun. 21, 2022

(54) DEVICE FOR LIMITING SWAY IN AN ELEVATOR TRAVELLING CABLE

(71) Applicant: Otis Elevator Company, Farmington, CT (US)

(72) Inventors: Jean-Emile Rocher, Lorris (FR); Frederic Beauchaud, Coullons (FR); Emmanuel Convard, La Bussiere (FR); Guillaume Trouvain, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 212 days.

(21) Appl. No.: 16/730,494

(22) Filed: Dec. 30, 2019

(65) Prior Publication Data

US 2021/0002103 A1 Jan. 7, 2021

(30) Foreign Application Priority Data

Jul. 5, 2019 (EP) ..... 19305918

(51) Int. Cl.
*B66B 11/00* (2006.01)
*B66B 7/06* (2006.01)

(52) U.S. Cl.
CPC ..... *B66B 11/008* (2013.01); *B66B 7/06* (2013.01); *B66B 7/064* (2013.01)

(58) Field of Classification Search
CPC ..... B66B 7/06; B66B 7/064
See application file for complete search history.

(56) References Cited

U.S. PATENT DOCUMENTS 2,017,372 A 10/1935 Morrison
6,786,306 B2 * 9/2004 Tiner ..... B66B 7/064 187/266
2020/0079622 A1 * 3/2020 Yan ..... B66B 7/06

FOREIGN PATENT DOCUMENTS

JP H 03-13478 A * 1/1991
JP H0313478 A 1/1991
JP H 06-278968 A * 3/1993
JP 2007153588 A * 6/2007

OTHER PUBLICATIONS

English Machine Translation of JPH 03-13478.*
English Machine Translation of JPH 06-278968.*
European Search Report for application for EP 19305918.5, dated Feb. 19, 2020, 20 pages.

* cited by examiner

*Primary Examiner* — Diem M Tran
(74) *Attorney, Agent, or Firm* — Cantor Colburn LLP

(57) ABSTRACT

A device for limiting sway in a travelling cable (6) in an elevator system is provided. The device comprises: a channel extending in a first direction for receiving the travelling cable (6) therein, wherein the channel is configured to be mounted in an elevator hoistway (2) such that the first direction corresponds to a direction of motion of an elevator car (4) within the hoistway (2); and an element (20) configured to move in the first direction along an open side of the channel simultaneously with an elevator car (4) and to push the travelling cable (6) into the channel when the element (20) moves along the open side thereof.

15 Claims, 5 Drawing Sheets

DEVICE FOR LIMITING SWAY IN AN ELEVATOR TRAVELLING CABLE

FOREIGN PRIORITY

This application claims priority to European Patent Application No. 19305918.5, filed Jul. 5, 2019, and all the benefits accruing therefrom under 35 U.S.C. § 119, the contents of which in its entirety are herein incorporated by reference.

TECHNICAL FIELD

This disclosure relates to an elevator system comprising an elevator car moveable within a hoistway and a travelling cable connecting the elevator car to a power supply and/or to a controller.

BACKGROUND

It is known to provide one or more travelling cables connected to an elevator car in a hoistway in a building. Typically, the elevator car may be configured to move vertically within the hoistway and a first end of the travelling cable(s) may be connected to a base of the elevator car to move with the elevator car. A second end of the travelling cable(s) may be directly or indirectly connected to a power supply and/or to a controller. The power supply and/or controller may be located in or adjacent to the hoistway. Alternatively, the power supply and/or controller may be located remote from the hoistway and a further connection may be provided between the travelling cable(s) and the power supply and/or controller.

If a building in which an elevator system is located is caused to sway, for example due to an earthquake, the travelling cable(s) in the hoistway can also sway and, as a result, can become entangled with each other or with other structure, ropes or cables in the hoistway.

There is therefore a need to provide a device to limit the sway of travelling cables so as to avoid a traveling cable becoming entangled with itself or other items in an elevator hoistway during earthquakes or other extreme conditions.

SUMMARY

According to a first aspect of the disclosure there is provided a device for limiting sway in an elevator travelling cable, the device comprising: a channel extending in a first direction for receiving the travelling cable therein, wherein the channel is configured to be mounted in an elevator hoistway such that the first direction corresponds to a direction of motion of an elevator car within the hoistway; and an element configured to move in the first direction along an open side of the channel simultaneously with an elevator car and to push the travelling cable into the channel when the element moves along the open side thereof.

By providing an element configured to move in the first direction along the open side of the channel simultaneously with an elevator car and to push a travelling cable into the channel when the element moves along the channel, a portion of the travelling cable can be held within the channel in use. When a building in which an elevator is located is subjected to significant sway, for example during an earthquake, the travelling cable extending below the elevator car can oscillate or swing from side to side. This can cause the travelling cable to become entangled with itself or with other structure, ropes or cables in the hoistway. For example, the portion of the travelling cable hanging down below the elevator car may become entangled with the part of the travelling cable hanging down from the hoistway. By holding a part of the travelling cable within the channel, the device according to the first aspect of the disclosure reduces the likelihood of the travelling cable becoming entangled in itself in this way.

The element could take many different forms. In one example of the disclosure, the element could comprise a slider adapted to slide over the travelling cable and to push the travelling cable into the channel when the element moves along the channel. In one example of the disclosure, the element may comprise a sheave. The sheave may be adapted to rotate about an axis extending across the channel and perpendicular to the first direction.

In some examples, additionally or alternatively, the device may further comprise: a first guiding portion extending parallel and adjacent to the channel on a first side thereof; a second guiding portion extending parallel and adjacent to the channel on a second side thereof, opposite to the first guiding portion; a first guide element connected to a first side of the element and positioned within the first guiding portion so as to be moveable in the first direction; and a second guide element connected to a second side of the element and positioned within the second guiding portion so as to be moveable in the first direction. This allows the element or sheave to be guided smoothly in its travel along the channel and to be held within the channel.

When subjected to an uneven force distribution, the element or sheave could be caused to twist and could become stuck or be damaged. In some examples, additionally or alternatively therefore, the device may further comprise: a first arm extending from the first guide element in the first direction; a second arm extending from the second guide element in the first direction; a third guide element provided on the first arm and positioned within the first guiding portion so as to be moveable in the first direction, wherein the third guide element is spaced from the first guide element in the first direction; and a fourth guide element provided on the second arm and positioned within the second guiding portion so as to be moveable in the first direction, wherein the fourth guide element is spaced from the second guide element in the first direction. It will be understood that the provision of the first and third guide elements and second and fourth guide elements which are spaced apart in the first direction will improve the alignment of the element or sheave in the channel.

The first and second guide elements could take many different forms. In one example, the first and second guide elements could comprise sliding guides adapted to slide in the first direction within the first and second guiding portions. In one example of the disclosure however, in addition or alternatively, the first and second guide elements may comprise rollers. This will reduce the frictional forces acting against the movement of the element or sheave in the first direction.

In some examples, additionally or alternatively, the third and fourth guide elements may comprise rollers. This will again reduce the frictional forces acting against the movement of the element or sheave in the first direction.

There will be frictional forces between the first, second, third and fourth guide elements (referred to hereafter as the guide elements) and the respective first and second guiding portions which act to slow or even stop the movement of the guide elements within the guiding portions. In some examples, additionally or alternatively therefore, the first and second arms may have a weight sufficient to overcome frictional resistance to movement of guide elements in the first and second guiding portions. The arms may be formed from a sufficiently dense material to provide the required weight thereof. Alternatively however, weights may be provided on the first and second arms.

As one side of the channel is open, and the channel may extend over a significant distance (one half of the height of an elevator hoistway in one example of the disclosure), it is desirable to provide additional structure to hold a travelling cable inside the channel once it has been pushed into the channel by an element according to the disclosure. In some examples of the disclosure therefore, additionally or alternatively, the device may further comprise: a first brush seal extending from a first side wall of the channel; and a second brush seal extending from a second, opposite side wall of the channel towards the first brush seal.

It will be appreciated that the device according to the present disclosure is for use in an elevator system. From a further aspect therefore, an elevator system is provided comprising: a hoistway; an elevator car moveable within the hoistway; a travelling cable connecting the elevator car to a power supply and/or to a controller; and a device as described in any of the examples or alternatives above, wherein the channel is mounted in the elevator hoistway.

Usually although not exclusively, an elevator car may be configured to move vertically within an elevator hoistway. In one example therefore, the first direction is a vertical direction.

In one example of the disclosure, the channel may be mounted directly to a wall of the elevator hoistway. In another alternative example, the channel may be mounted to a structure located in the elevator hoistway. The structure may be but need not be mounted to a wall of the elevator hoistway. In one example, the channel may be mounted to one or more combined guide rail brackets in the hoistway.

In one example, the travelling cable may extend within the channel above the element and the element may push the travelling cable adjacent thereto into the channel when the element moves downwardly along the open side of the channel.

Various mechanisms for driving the movement of the element along the channel could be provided. For example, a motorised drive for the element could be provided. In certain examples however, the motion of the elevator car in the hoistway may be used to drive the motion of the element along the channel. In a first alternative example, if the travelling cable is sufficiently strong, the travelling cable may be connected to the element to drive the element in the first direction along an open side of the channel simultaneously with the elevator car. Thus, in one alternative example, the travelling cable could extend around a sheave in order to drive the motion of the element. As the travelling cable is connected to and moves with the elevator car, the sheave would be caused to move simultaneously with the car when connected to the travelling cable in this way.

In some known elevator systems, the travelling cable would not be suitable to use to drive the element in the device according to the disclosure as the travelling cable might be damaged by such use, potentially causing an elevator system to be put out of service. In another alternative example therefore, a strap may be provided extending between the elevator car and the element, wherein the strap is configured to drive the element in the first direction along an open side of the channel simultaneously with the elevator car. Thus, in one example, the element may comprise a sheave and the strap may extend around the sheave in order to cause the sheave to move simultaneously with the elevator car.

In one example, the strap may be positioned on the elevator car to avoid interference with the travelling cable. Thus, for example, the strap may extend from an upper or side surface of the elevator car.

DRAWING DESCRIPTION

Certain examples of this disclosure will now be described, by way of example only, with reference to the accompanying drawings, in which:

FIG. 1*a* is a schematic elevation of an elevator system including a hoistway, an elevator car and a device according to an example of the disclosure, with the elevator car in a first position in the hoistway;

FIG. 1*b* is a schematic elevation of the elevator system of FIG. 1*a*, with the elevator car in a second position in the hoistway;

FIG. 1*c* is a schematic elevation of the elevator system of FIG. 1*a*, with the elevator car in a third position in the hoistway;

DETAILED DESCRIPTION

Figure 1A:
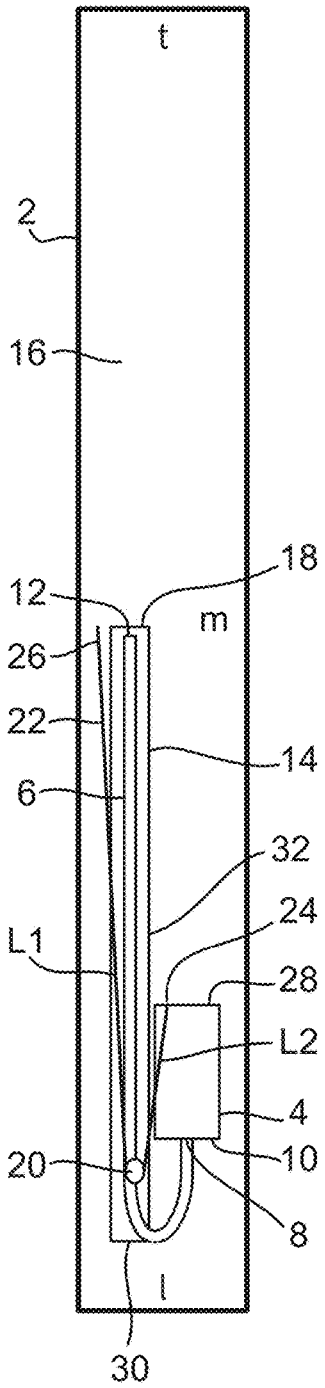
Figure 1B:
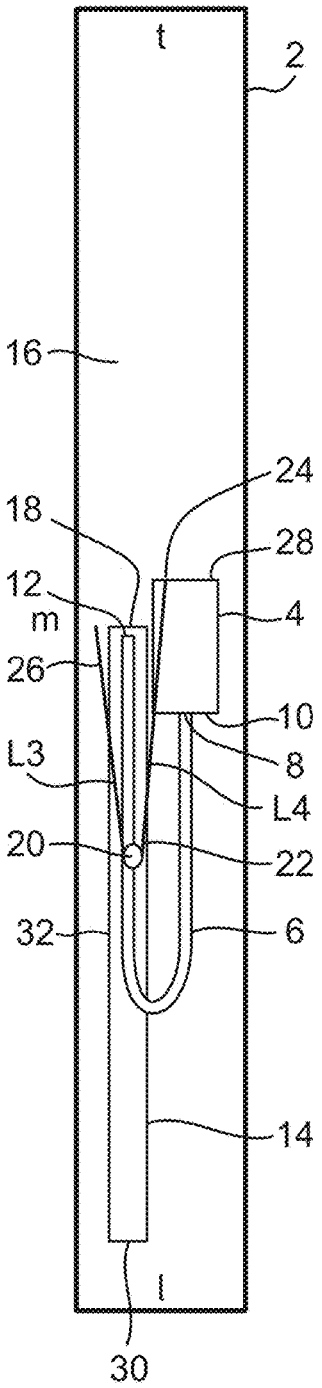
Figure 1C:
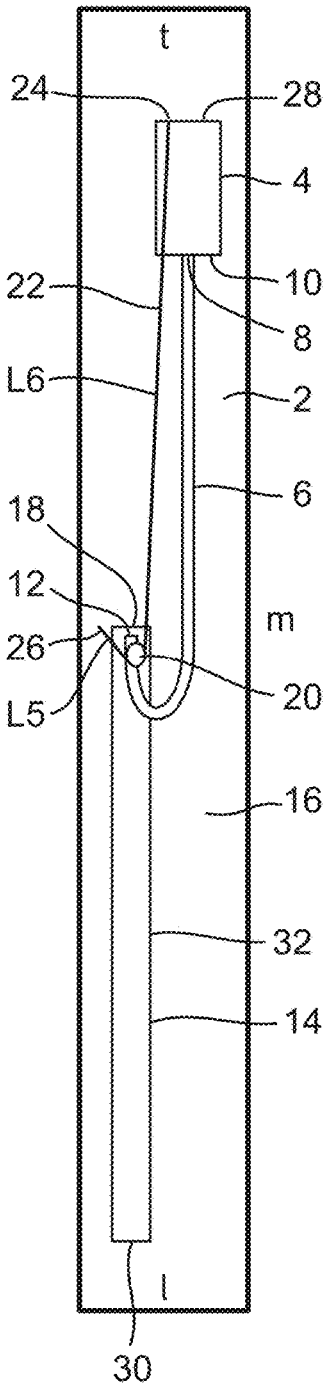

FIG. 1*a* is a schematic side view of a hoistway 2 of an elevator system and an elevator car 4 located in the hoistway 2. The elevator car 4 is vertically moveable within the hoistway 2. A first end 8 of a travelling cable 6 is connected to the elevator car 4 at the base 10 thereof. A second, opposite end 12 of the travelling cable 6 may be fixed relative to the hoistway 2. In one example, the second end 12 of the travelling cable 6 may be fixed approximately midway along the vertical extent of the hoistway 2 (i.e. at mid-rise m) and may be directly or wirelessly connected to a power supply (not shown) and/or to an elevator controller (not shown). As seen in FIGS. 1*a* to 1*c*, the travelling cable 6 extends downwardly from the base 10 of the elevator car 4 and then bends through approximately 180 degrees to extend back up through the hoistway 2 until reaching the second end 12 of the travelling cable 6 which is fixed relative to the hoistway 2 at approximately midway along the vertical extent of the hoistway 2. The travelling cable may be sufficiently long to allow the elevator car 4 to travel over the full length of the hoistway 2 whilst maintaining some slack in the travelling cable 6 at all points of travel of the elevator car 4.

Although only a single travelling cable 6 is shown in FIGS. 1*a* to 1*c*, it will be appreciated that one or more travelling cables of the type shown may be provided in an elevator system according to the disclosure.

As shown in FIGS. 1*a* to 1*c*, according to one example of the disclosure, a guide 14 in which the travelling cable 6 is received extends vertically within the hoistway 2 from mid-rise m to a lower part 1 of the hoistway 2. In one example, the guide 14 may extend to the lowermost extent of motion of the elevator car 4 in the hoistway 2. In one example, the guide 14 may be fixed to a wall 16 of the hoistway 2. In another example, the guide 14 may be fixed relative to a wall 16 of the hoistway 2. For example, the guide 14 may be fixed to one or more combined guide rail brackets (not shown in FIGS. 1*a* to 1*c*) in the hoistway 2 as will be described further below. The second end 12 of the travelling cable 6 may for example be fixed to the guide 14 or directly to the wall 16 of the hoistway 2 or to a combined guide rail bracket. In the example of FIGS. 1*a* to 1*c*, the second end 12 of the travelling cable 6 is fixed to the guide 14 at a first end 18 of the guide 14 at approximately mid-rise m in the hoistway 2.

As will be described in further detail below, a guiding device is provided to travel vertically within the guide 14 and is adapted to hold the travelling cable 6 within the guide 14. In one example of the disclosure which will be described further below, the guiding device may include an element which may comprise a sheave 20 adapted to contact and rotate relative to the travelling cable 6. The portion of the travelling cable 6 extending between the sheave 20 and the second end 12 of the travelling cable 6 may extend within and along the guide 14 and may be held in the guide 14 by the sheave 20 as will be described in further detail below. The portion of the travelling cable 6 extending between the sheave 20 and the first end 8 of the travelling cable 6 is not held within the guide 14 and so is free to move.

The sheave 20 is caused to move vertically with the elevator car 4 to travel within the guide 14. In the example shown, the vertical movement is achieved by a strap 22 which extends around the sheave 20, a first end 24 of the strap 22 being attached to the elevator car 4 and the other second end 26 of the strap 22 being fixed relative to the wall 16 of the hoistway 2 adjacent the first end 18 of the guide 14, i.e. approximately at mid-rise m. In one example, the strap 22 may be fixed to a wall 16 of the hoistway 2. In another example, the strap 22 may be fixed relative to a wall 16 of the hoistway 2. For example, the strap 22 may be fixed to one or more combined guide rail brackets (not shown in FIGS. 1*a* to 1*c*) in the hoistway 2.

The strap 22 may be fixed to any suitable part of the elevator car 4 to move with the elevator car 4. In the example shown in FIGS. 1*a* to 1*c*, the strap 22 is fixed to the roof 28 or an upper surface of the elevator car 4 so as to avoid possible interference with the travelling cable 6 extending from the base 10 of the elevator car 4.

As seen in FIG. 1*a*, when the elevator car 4 is located towards the lowermost part 1 of the hoistway 2, the sheave 20 is in a first position below the elevator car 4 towards a second, lower end 30 of the guide 14. In this position, a longer length L1 of the strap 22 may extend between the sheave 20 and the second end 26 of the strap 22 than the length L2 of the strap 22 extending between the sheave 20 and the roof 28 of the elevator car 4.

As seen in FIG. 1*b*, when the elevator car 4 is located at approximately midrise m in the hoistway 2, the sheave 20 is in a second position below the elevator car 4, beyond a midpoint 32 of the guide 14. In this position, the length L3 of the strap 22 extending between the sheave 20 and the second end 26 of the strap 22 may be only slightly less than or approximately the same as the length L4 of the strap 22 extending between the sheave 20 and the roof 28 of the elevator car 4.

As seen in FIG. 1*c*, when the elevator car 4 is located at its uppermost extent of travel in the hoistway 2 towards the top t of the hoistway 2, the sheave 20 is in a third position below the elevator car 4, towards the first, upper end 18 of the guide 14. In this position, the length L5 of the strap 22 extending between the sheave 20 and the second end 26 of the strap 22 may be much less than the length L6 of the strap 22 extending between the sheave 20 and the roof 28 of the elevator car 4.

Figure 2:
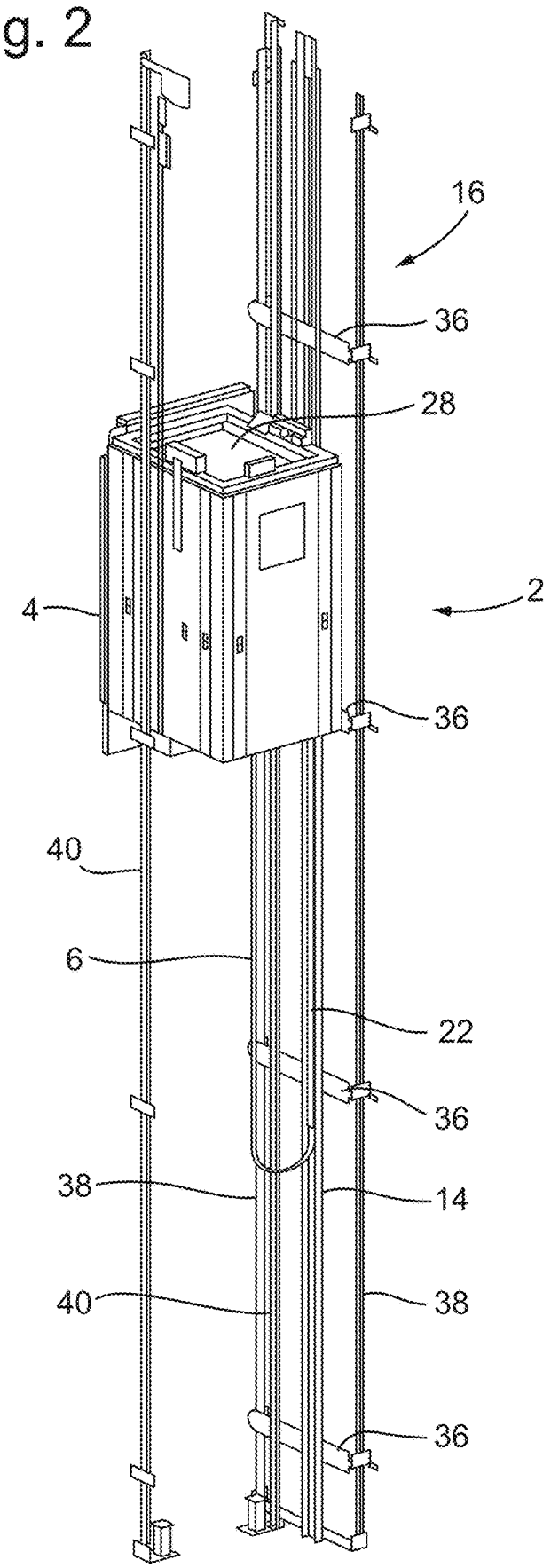
FIG. 2 is a schematic perspective view of an elevator hoistway according to an example of the disclosure.

As seen in FIG. 2, an elevator system may comprise a number of combined guide rail brackets 36 spaced vertically from each other and attached to a wall 16 of a hoistway 2 so as to extend horizontally. A number of counterweight guide rails 38 and car guide rails 40 may be attached to the combined guide rail brackets 36 so as to extend vertically along the extent of the hoistway 2. The guide 14 of the present disclosure may also be mounted to the combined guide rail brackets 36 so as to fix the guide 14 relative to the wall 16 of the hoistway 2 to which the combined guide rail brackets 36 are attached.

Figure 3:
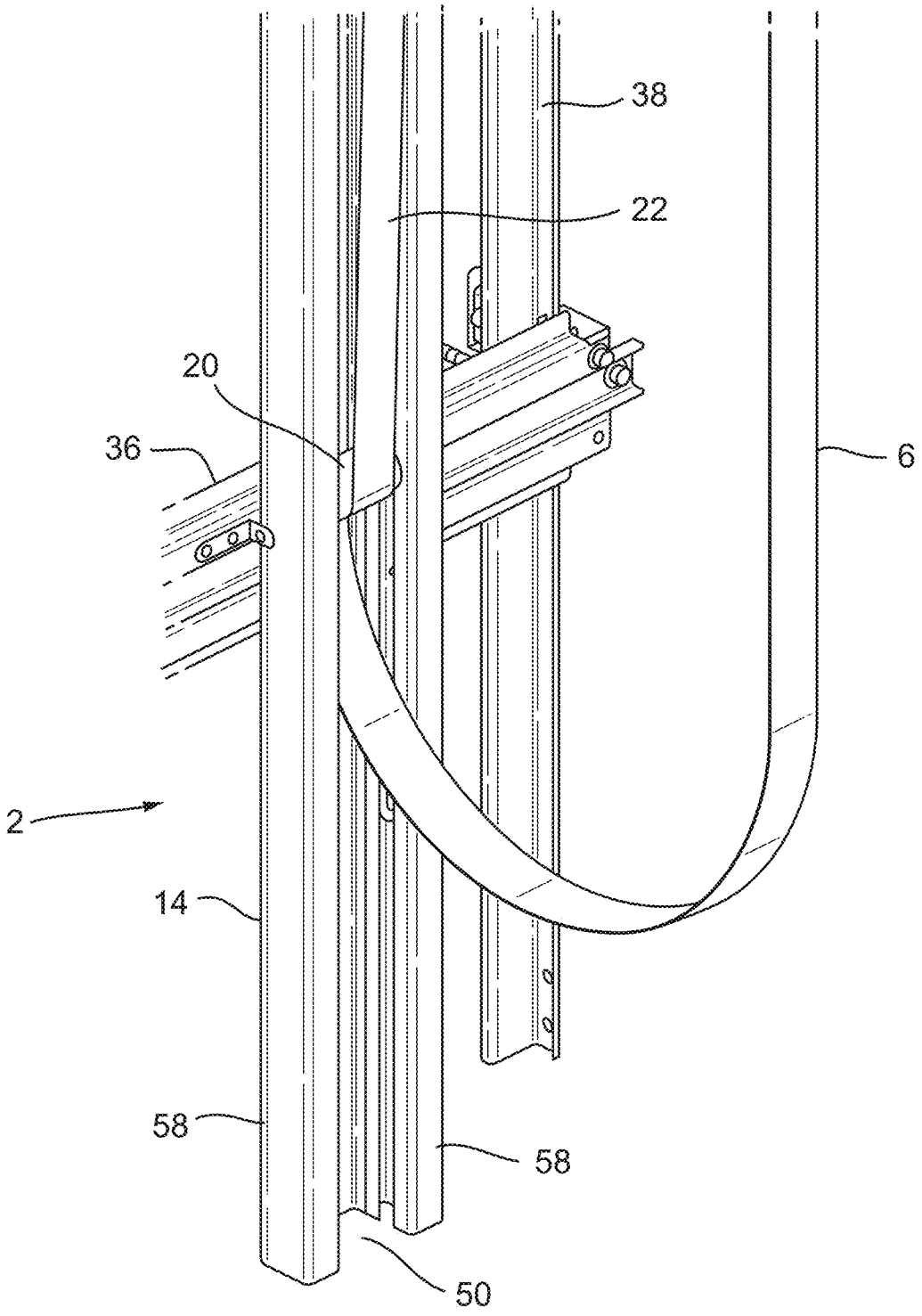
FIG. 3 is a perspective view of a portion of a device according to the present disclosure.
Figure 4:
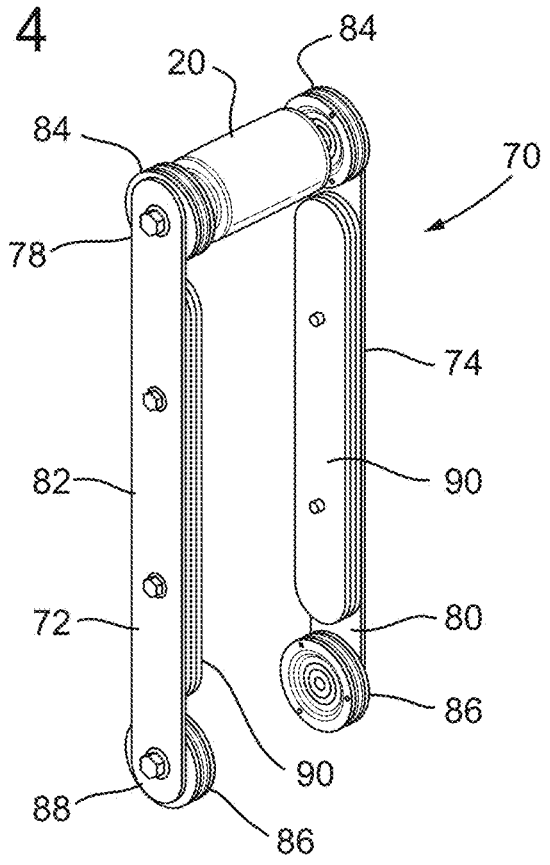
FIG. 4 is an exploded perspective view showing a portion of a device according to an example of the disclosure.
Figure 4:
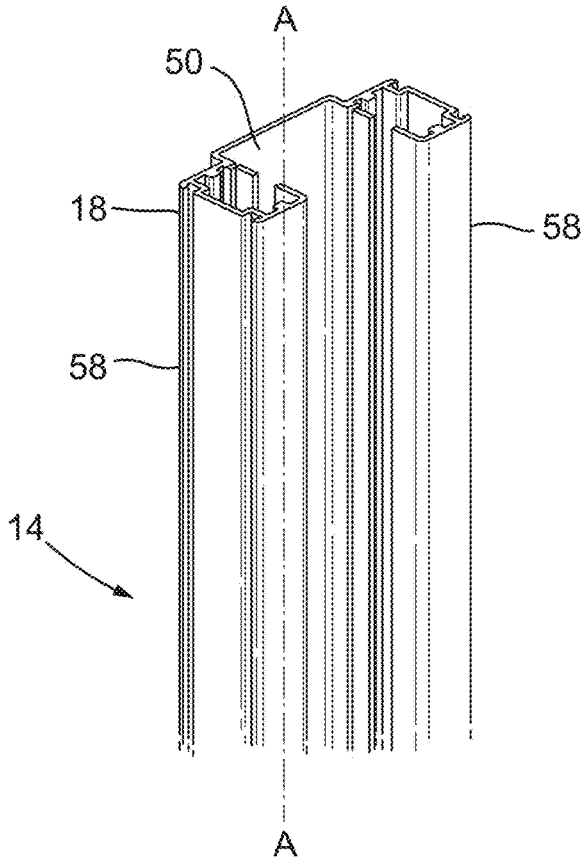
Figure 5:
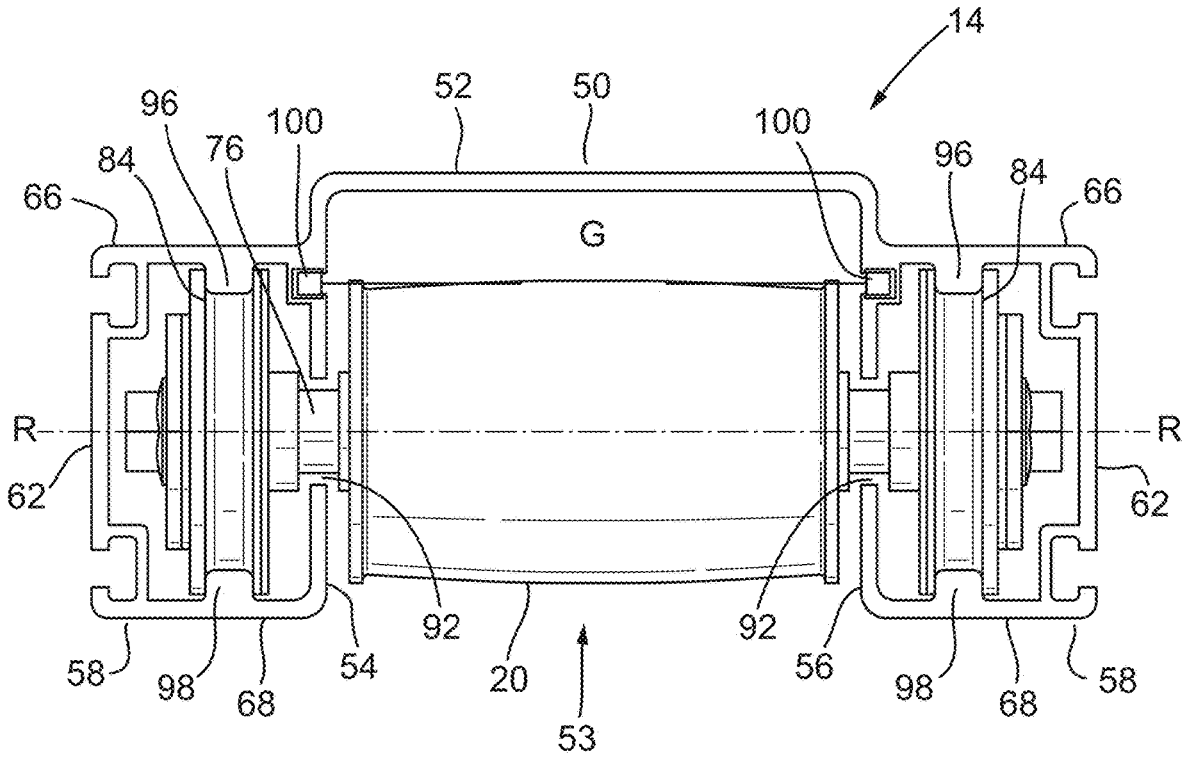
FIG. 5 is a cross section through the device of FIG. 4.

A guide 14 according to an example of the present disclosure is shown in further detail in FIGS. 3 to 5. FIG. 3 is a perspective view of a portion of the guide 14 of FIG. 2 attached to a combined guide rail bracket 36 in an elevator hoistway 2.

FIG. 4 is an exploded perspective view showing a portion adjacent the first end 18 of the guide 14 and a sheave 20 according to an example of the disclosure. FIG. 5 is a cross section through a guide 14 according to one example of the disclosure with the sheave 20 assembled therein. As seen in FIGS. 4 and 5, the guide 14 extends in a first direction (not shown) along an axis A-A which may be aligned with the vertical direction when the guide 14 is assembled in a hoistway 2. The guide 14 comprises a channel or a central portion 50 extending along the axis A-A. The central portion 50 has a U-shaped profile in cross section and comprises a first wall 52 configured to extend parallel to a wall 16 of the hoistway 2 when the guide 14 is assembled in the hoistway 2. Second and third walls 54, 56 extend perpendicular to the first wall 52 and parallel to the axis A-A at either end of the first wall 52. It will be understood that a face of the channel 50 opposite the first wall 52 forms and open side 53 of the channel 50. A guiding portion 58 may be provided adjacent each of the second and third walls 54, 56. Each guiding portion 58 may comprise a closed rectangular profile in cross section for receiving one or more vertically aligned guide elements therein. Thus, each guiding portion 58 may comprise one of the second and third walls 54, 56 and a further wall 62, 64 extending parallel to and spaced from the second or third wall 54, 56 and joined to the second or third wall 54, 56 by fourth and fifth walls 66, 68 extending perpendicular thereto.

As seen in FIG. 4, the guiding portions 58 of the guide 14 are adapted to receive guide elements connected to the element or sheave 20 to guide the movement of the sheave 20. It will be understood that the guide elements could take various different forms including wheels or sliders. In the example shown, the guide elements may comprise rollers. In the example of FIGS. 4 and 5, the device includes a first arm 72 linked to a second parallel arm 74 by a shaft 76 extending between the first and second arms 72, 74 at a first end 78 thereof. The first and second arms 72, 74 comprise an inner surface 80 facing towards the other of the first and second arms 72, 74 and an outer surface 82 opposite the inner surface 80. A respective first or second guide element 84 is rotatably mounted to the inner surface 80 of each of the first and second arms 72, 74 so as to rotate around the shaft 76. A sheave 20 is mounted between the respective first and second guide elements 84 to rotate around the shaft 76, the axis of rotation R-R of the sheave 20 corresponding to the longitudinal axis of the shaft 76. A respective third or fourth guide element 86 is rotatably mounted to the inner surface 80 of each of the first and second arms 72, 74 at a second end 88 of the first and second arms 72, 74 removed from the shaft 76.

Weights or filling material 90 may be provided on the first and second arms 72, 74 to overcome any frictional forces acting on the first, second, third and fourth guide elements and to allow smooth movement of the guiding device 70 in the guiding portions 58. In the example shown, the weights 90 comprise longitudinal panels attached to the inner surfaces 80 of the first and second arms 72, 74 between the first and second and third and fourth guide elements 84, 86 (hereafter referred to as the guide elements).

As seen in FIG. 5, a guide channel 92 extending parallel to the axis A-A is provided in each of the second and third walls 54, 56 for receiving the shaft 76 such that in use, the guide elements 84, 86 are received within the respective guiding portions 58 and the shaft 76 and sheave 20 extend across the central portion 50 of the guide 14. In addition, protrusions extend inwardly from the fourth and fifth walls 66, 68 to form first and second guide rails 96, 98 internally of and on opposite sides of the respective guiding portions 58. Thus, each of the respective guide elements 84, 86 will engage with and be guided by the first and second guide rails 96, 98 as they move vertically within the first and second guiding portions 58 in use.

A gap G is provided between the sheave 20 and the first wall 52 of the guide 14 as seen in FIG. 5. When fully assembled in an elevator system, a travelling cable 6 of the elevator system extends along the channel 50 along the axis A-A so as to pass between the first wall 52 and the sheave 20. Brush seals 100 may be provided on the second and third walls 54, 56 respectively extending into the channel 50 in front of the gap G. The brush seals 100 may act to hold the travelling cable 6 inside the channel 50 above the sheave 20. As the second end 12 of the travelling cable 6 is fixed to the guide 14, the sheave 20 and the brush seals 100 act to hold the portion of the travelling cable extending between the second end 12 thereof and the sheave 20 within the channel 50. The portion of the travelling cable 6 extending from the sheave 20 to the elevator car 4 is in contrast free of the channel 50.

As discussed above, the strap 22 may be assembled to extend around the sheave 20 to cause the guiding device 70 to move within the guide 14 simultaneously with the elevator car 4. In an alternative example of the disclosure, if the travelling cable is sufficiently strong, the sheave 20 may be mounted directly to the traveling cable 6 to cause the sheave 20 to move and no strap 22 need be provided. When the sheave 20 is mounted directly to the traveling cable 6 in this way, the weight of the guiding device 70 will act to pull downwardly on the traveling cable 6 thus producing tension in the travelling cable extending between the sheave 20 and the elevator car 4 so as to limit movement of the travelling cable extending between the sheave 20 and the elevator car 4.

In use, when the elevator car 4 moves downwardly in the hoistway 2, the guiding device 70 is caused to move downwardly within the guide 14 with the elevator car. The travelling cable 6 extends out from the channel 50 below the sheave 20 as discussed above. As the guiding device 70 moves downwardly, the sheave 20 of the guiding device 70 acts to push the travelling cable 6 adjacent the sheave 20 through the brush seals 100 and into the channel 50.

Although the present disclosure has been described with reference to various examples, it will be understood by those skilled in the art that various changes in form and detail may be made without departing from the scope of the disclosure as set forth in the accompanying claims.

What is claimed is:

1. A device for limiting sway in a travelling cable (6) in an elevator system, the device comprising:

a channel (50) extending in a first direction for receiving the travelling cable (6) therein, wherein the channel (50) is configured to be mounted in an elevator hoistway (2) such that the first direction corresponds to a direction of motion of an elevator car (4) within the hoistway (2); and an element (20) configured to move in the first direction along an open side (53) of the channel (50) simultaneously with the elevator car (4) and to push the travelling cable (6) into the channel (50) when the element (20) moves along the open side (53) thereof;

a first guiding portion (58) extending parallel and adjacent to the channel (50) on a first side thereof;

a second guiding portion (58) extending parallel and adjacent to the channel (50) on a second side thereof, opposite to the first guiding portion (58);

a first guide element (84) connected to a first side of the element (20) and positioned within the first guiding portion (58) so as to be moveable in the first direction; and a second guide element (84) connected to a second side of the element (20) and positioned within the second guiding portion (58) so as to be moveable in the first direction;

a first arm (72) extending from the first guide element (84) in the first direction;

a second arm (74) extending from the second guide element (84) in the first direction;

a third guide element (86) provided on the first arm (72) and positioned within the first guiding portion (58) so as to be moveable in the first direction, wherein the third guide element (86) is spaced from the first guide element (84) in the first direction, wherein the third guide element (86) is spaced directly beneath the first guide element (84) in the first direction; and a fourth guide element (86) provided on the second arm (74) and positioned within the second guiding portion (58) so as to be moveable in the first direction, wherein the fourth guide element (86) is spaced from the second guide element (84) in the first direction, wherein the fourth guide element (86) is spaced directly beneath the second guide element (84) in the first direction.

2. A device as claimed in claim 1, wherein the element (20) comprises a sheave.

3. A device as claimed in claim 2, wherein the sheave (20), the first guide element (84) and the second guide element (84) are aligned on a common axis of rotation.

4. A device as claimed in claim 1, wherein the first and second guide elements (84) comprise rollers.

5. A device as claimed in claim 1, wherein the third and fourth guide elements (86) comprise rollers.

6. A device as claimed in claim 1, wherein the first and second arms (72, 74) have a weight sufficient to overcome frictional resistance to movement of the first, second, third and fourth guide elements (84, 86) in the first and second guiding portions (58).

7. A device as claimed in claim 6, wherein weights (90) are provided on the first and second arms (72, 74).

8. A device as claimed in claim 1, further comprising:

a first brush seal (100) extending from a first side wall (54) of the channel (50); and a second brush seal (100) extending from a second, opposite side wall (56) of the channel (50) towards the first brush seal (100).

9. A device as claimed in claim 1, wherein the traveling cable (6) provides electrical power to the elevator car (4).

10. An elevator system comprising:

a hoistway (2);

an elevator car (4) moveable within the hoistway (2);

a travelling cable (6) connecting the elevator car (4) to a power supply and/or to a controller; and a device as claimed in claim 1, wherein the channel (50) is mounted in the elevator hoistway (2).

11. An elevator system as claimed in claim 10, wherein the first direction is a vertical direction.

12. An elevator system as claimed in claim 11, wherein the travelling cable (6) extends within the channel (50) above the element (20) and the element (20) pushes the travelling cable (6) adjacent thereto into the channel (50) when the element (20) moves downwardly along the open side (53) of the channel (50).

13. An elevator system as claimed in claim 10, wherein the travelling cable (6) is connected to the element (20) to drive the element (20) in the first direction along an open side (53) of the channel (50) simultaneously with the elevator car (4).

14. An elevator system as claimed in claim 10, further comprising a strap (22) extending between the elevator car (4) and the element (20), wherein the strap (22) is configured to drive the element (20) in the first direction along an open side (53) of the channel (50) simultaneously with the elevator car (4).

15. An elevator system as claimed in claim 14, wherein the strap (22) is positioned on the elevator car (4) to avoid interference with the travelling cable (6).

* * * * *